US006585609B2

(12) United States Patent
Bays et al.

(10) Patent No.: US 6,585,609 B2
(45) Date of Patent: Jul. 1, 2003

(54) GOLF SHOT MAPPING AND ANALYSIS SYSTEM

(76) Inventors: John Bays, 4821 Narragansett Ave., San Diego, CA (US) 92107-3104; Craig Graber, 5620 Paseo del Norte, Box 127217, Carlsbad, CA (US) 92008

( * ) Notice: Subject to any disclaimer, the term of this patent is extended or adjusted under 35 U.S.C. 154(b) by 0 days.

(21) Appl. No.: 09/756,612

(22) Filed: Jan. 5, 2001

(65) Prior Publication Data

US 2002/0091019 A1 Jul. 11, 2002

(51) Int. Cl.[7] ..... A63B 57/00; G06F 155/00

(52) U.S. Cl. ..... 473/407; 700/91

(58) Field of Search ..... 473/407, 168–169, 473/170–172, 173–176, 283, 403–404, 409, 156, 131; 700/91, 92; 434/252

(56) References Cited

U.S. PATENT DOCUMENTS

| | | | | |
|---|---|---|---|---|
| 4,666,157 A | | 5/1987 | Bodine | |
| 5,127,044 A | | 6/1992 | Bonito | |
| 5,245,537 A | | 9/1993 | Barber | |
| 5,507,485 A | | 4/1996 | Fisher | |
| 5,558,333 A | | 9/1996 | Kelson et al. | |
| 5,740,077 A | | 4/1998 | Reeves | |
| 5,762,561 A | * | 6/1998 | Zine | 473/131 |
| 5,797,809 A | | 8/1998 | Hyuga | |
| RE36,346 E | | 10/1999 | Germain | |

* cited by examiner

*Primary Examiner*—Kim Nguyen
(74) *Attorney, Agent, or Firm*—Brown Martin Haller & McClain LLP

(57) ABSTRACT

Aerial photographs are utilized to produce an image of images which illustrate the topography of golf holes from an overhead perspective. The images are digitized and each element is assigned to an array of x-y positions (cells) on the hole or green. This information is loaded into a computer database on a server. A comparable image is reproduced in a scoring booklet which shows prominent landmarks on the course. Each shot position is recorded on the scoring booklet by reference to the physical and illustrated landmarks. After a round, the golfer goes to a web site on the Internet and clicks on the corresponding positions on the image presented. These positions are used to calculate the distance and drift of each shot and stored in the server database where they can be compared, say, for example, to that golfer's and other golfers' previous rounds for that hole and club.

5 Claims, 7 Drawing Sheets

Figure 6

Member Table

| | | |
|---|---|---|
| Name | Text | Members name |
| ID | AutoNumber | Unique ID |
| Street address | Text | Members address if supplied |
| Zip | Number | Zip code required |
| Phone | Number | Phone number if supplied |
| Email | Text | Email address required |
| Sex | Number | Male or Female required |
| Age | Number | Members age required |
| Brand | Text | Type of equipment used if supplied |
| Skill | Number | Skill level of golfer - Novice, Beginner, Advanced, Professional |
| Years | Number | Years of experience |
| Hanidcap | Number | Handicap |
| SLR | Number | Score Last Round |
| LDLR | Number | Longest Drive Last Round |
| TNDLR | Number | Total Number of Drives Last Round |
| ADLR | Number | Average Drive Last Round |
| APPHLR | Number | Average Putts Per Hole Last Round |
| GIRLR | Number | Greens In Regulation Last Round |
| LPLR | Number | Longest Putt Last Round |
| TPLR | Number | Total Putts Last Round |
| BOGLR | Number | Bogies Per Round Last Round |
| PPRLR | Number | Pars Per Round Last Round |
| BPRLR | Number | Birdies Per Round Last Round |
| EPRLR | Number | Eagles Per Round Last Round |
| ALR | Number | Aces Last Round |
| THPYTD | Number | Total Holes Played Year To Date |
| TRPYTD | Number | Total Rounds Played Year To Date |
| LDYTD | Number | Longest Drive Year To Date |
| TNDYTD | Number | Total Number of Drives Year To Date |
| ADYTD | Number | Average Drive Year To Date |
| TDDYTD | Number | Total Driving Distance Year To Date |
| APPHYTD | Number | Average Putts Per Hole Year To Date |
| GIRYTD | Number | Greens In Regulation Year To Date |
| LPYTD | Number | Longest Putt Year To Date |
| APTPRYTD | Number | Average PuTts Per Round Year To Date |
| TBOGYTD | Number | Total Bogies Year To Date |
| ABOGYTD | Number | Average Bogies Per Round Year To Date |
| TPYTD | Number | Total Pars Year To Date |
| APPRYTD | Number | Average Pars Per Round Year To Date |
| TBYTD | Number | Total Birdies Year To Date |
| ABPRYTD | Number | Average Birdies Per Round Year To Date |
| TEYTD | Number | Total Eagles Year To Date |
| AEPRYTD | Number | Average Eagles Per Round Year To Date |
| TAYTD | Number | Total Aces Year To Date |
| THPLT | Number | Total Holes Played Life Time |
| TRPLT | Number | Total Rounds Played Life Time |
| LDLT | Number | Longest Drive Life Time |
| TNDLT | Number | Total Number of Drives Life Time |
| ADLT | Number | Average Drive Life Time |
| TDDLT | Number | Total Driving Distance Life Time |
| APPHLT | Number | Average Putts Per Hole Life Time |
| GIRLT | Number | Greens In Regulation Life Time |
| LPLT | Number | Longest Putt Life Time |
| APTPRLT | Number | Average PuTts Per Round Life Time |
| TBOGLT | Number | Total Bogies Life Time |
| ABOGLT | Number | Average Bogies Per Round Life Time |
| TPLT | Number | Total Pars LIfe Time |
| APPRLT | Number | Average Pars Per Round Life Time |
| TBLT | Number | Total Birdies Life Time |
| ABPRLT | Number | Average Birdies Per Round LT |
| TELT | Number | Total Eagles Life Time |
| AEPRLT | Number | Average Eagles Per Round Life Time |
| TALT | Number | Total Aces Life Time |

Figure 7

Course Table

| Field Name | Data Type | Description |
|---|---|---|
| Course Name | Text | |
| Course ID | AutoNumber | |
| Course Address | Text | |
| Zip | Number | |
| Opening Date | Date/Time | Date the course opened |
| Course info | Memo | Description of course etc. |
| Events | Memo | Events at this course |
| PGA | Yes/No | PGA tour stop |
| PGA event date 1 | Date/Time | Date of tour event |
| PGA event date 2 | Date/Time | Date of tour event |
| PGA event 1 title | Text | |
| PGA event 2 title | Text | |
| Charts on hand | Number | Number of AmProCharts in stock |
| Chart reorder level | Number | Number at which to reorder |
| Hole 1 Scale | Number | |
| Green 1 Scale | Number | |
| Hole 1 Red Tee X | Number | X coordinate of Red Tee |
| Hole 1 Red Tee Y | Number | Y coordinate of Red Tee |
| Hole 1 Blue Tee X | Number | X coordinate of Blue Tee |
| Hole 1 Blue Tee Y | Number | Y coordinate of Blue Tee |
| Hole 1 White Tee X | Number | X coordinate of White Tee |
| Hole 1 White Tee Y | Number | Y coordiante of White Tee |
| Hole 1 pin position X | Number | X coordinate of pin position |
| Hole 1 pin position Y | Number | Y coordiante of pin position |
| Hole 1 Total Play count | Number | Total number of times hole has been played |
| Hole 1 Daily Play count | Number | Number of times hole has been played today |
| Hole 2 Scale | Number | |
| Green 2 Scale | Number | |
| Hole 2 Red Tee X | Number | X coordinate of Red Tee |
| Hole 2 Red Tee Y | Number | Y coordinate of Red Tee |

Shot Table

| Field Name | Data Type | Description |
|---|---|---|
| ID | AutoNumber | |
| Member ID | Number | Member ID from Member Table |
| Time stamp | Date/Time | Date/Time the record was written |
| Play date | Date/Time | Date the golfer played |
| Course ID | Number | Course ID from Course Table |
| Hole number | Number | The hole number |
| Pin placement | Yes/No | Is this a pin placement |
| Shot number | Number | The sequential shot number on this round |
| Club | Number | Club used for shot |
| Swing | Number | Half or full swing |
| Notes | Memo | Any notes on the shot |
| X coordinate | Number | |
| Y coordinate | Number | |
| Forward distance | Number | The change in X |
| Drift distance | Number | The change in Y |
| True distance | Number | The length of the hypotenuse |

GOLF SHOT MAPPING AND ANALYSIS SYSTEM

BACKGROUND OF THE INVENTION

Golf is a game on which much attention is directed to individual players' training, swing analysis, and game statistics. This interest in analysis of a player's performance has resulted in a great many products being introduced to aid in the analysis. For example, complex and expensive golf navigation systems have been developed to determine a player's position on the golf course and the distance to the nominal pin position. These systems may report the player's position to a central computer that can analyze various aspects of the golfer's round. Other devices have on-board intelligence that automates the score keeping process. However, despite these and other capabilities, most golfers still count their strokes after a hole is completed, and record their score on a conventional paper scorecard. These conventional scorecards may have no pictorial information, or may include a rough pictorial representation of the layout of fairways, hazards and greens. However, they typically provide no way to record the position of shots on the golf course or any way to convert the graphical representation into distance and directional information.

U.S. Pat. No. 5,740,077 requires the use of a portable data collection unit and position measuring equipment.

U.S. Pat. No. 5,797,809 is typical of a golf course management system where each player (or group) carries a guidance device that not only reads out distance and direction to the hole, but reports the player's position to a central location so that the speed of play can be managed by course officials.

U.S. Pat. No. 5,507,485 provides an interactive graphic display with on-board intelligence which shows pictorial representations of a golf course and can provide recommendations of the club to use for the next shot.

U.S. Pat. No. 5,245,537 provides a portable device that shows reference coordinates for specific golf course features, past player performance on that course may be downloaded to the device.

U.S. Pat. No. 5,127,044 uses a scoring sub-system for the entry of data and to display features of the golf course.

U.S. Pat. No. 4,666,157 provides a booklet with pictorial representatives of each hole and visible grid lines at, for example, specific yard intervals. The grid lines (and distance areas) are used as guidelines for club selection as the player executes the round. No provision is made for recording pin position. Different scales may be used for different holes. A film overlay is provided so that the position of each shot can be recorded and transferred "magnetically or in some other way" to a computer system for statistical analysis.

Pat. No. Re 36,346 provides a customized pictorial representation of each hole. A different character is written on the card to record the positions of successive shots. A special "reader" at the golf course is used to transfer the shot positions for subsequent analysis.

U.S. Pat. No. 5,558,333 shows a portable device with graphic representations of a hole and a pointer to permit the player to input ball positions directly into the device.

SUMMARY OF THE INVENTION

An exemplary embodiment of the invention overcomes the deficiencies of prior art systems by providing a scoring booklet with photographic representations of the fairways, approaches and greens. Every position on the pictorial representation is related, through a geographic grid system, to its true relationship to other positions on the course. An enlarged graphic is used to increase the resolution of shot placement for greens. A golfer marks each shot position on the card, and in doing so is able to use landmarks on the course including trees, bunkers, yard markers and even sprinkler heads and drains to accurately place the ball on the card and thereby accurately relate the ball position to the underlying geographic grid system. The final ball position for the last shot (putt) determines the position of the pin for that day.

After completion of a round, and whenever the golfer has access to an internet enabled computer with a web browser and pointing device (e.g., mouse), the information about the round of golf can be uploaded to a website. The data is transferred by clicking through opening menus, to a page on which the selected hole of the selected course is displayed. The system preferably employs the same photograph as is utilized in the scoring booklet. In this way, the course is viewed from the same perspective as it was when the shot position was recorded. The ball position for each shot is transferred, including the ball position for the last shot for each hole (pin position).

After the complete game is entered, the golfer can compare the current round with previously entered rounds and is presented with statistical analysis such as average distance and accuracy for each club. The accuracy of putting data is enhanced by compiling all the pin position entries for all golfers on that day (the position of the ball on the green when it is in the cup) These are compiled to produce a best estimate of pin position on that day and therefore increase the accuracy of the information about all recorded shots from that day which are related to pin position, including approach shots and putts.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which:

FIG. 6 is an example of the data types that may be stored in the member table.

FIG. 7 is an example of the data types that may be stored in the course table and shot table.

DETAILED DESCRIPTION OF THE DRAWINGS

Figure 1:
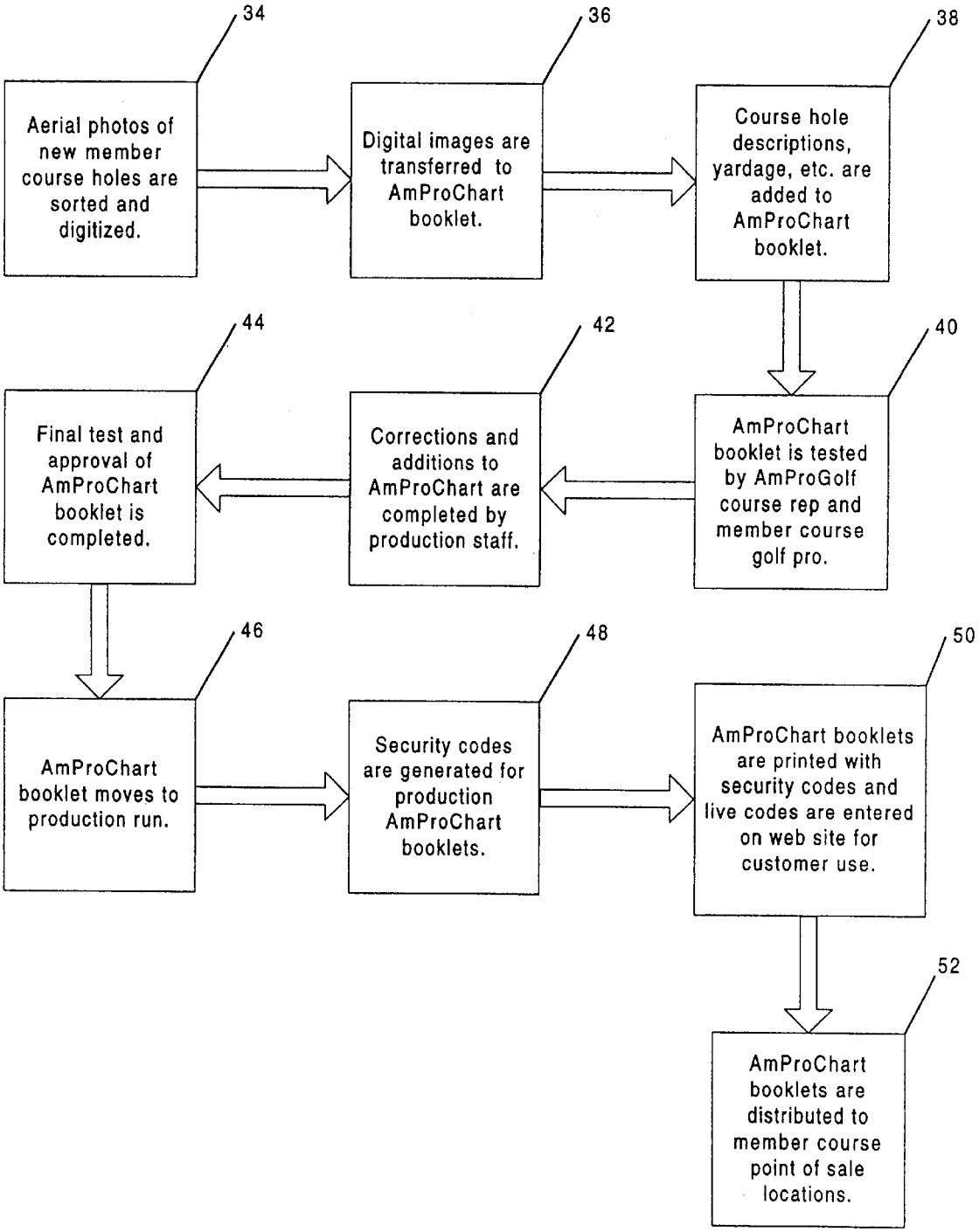
FIG. 1 Illustrates the process by which a course booklet is produced and checked and distributed.

The process for establishing a golf shot statistical system for a particular golf course proceeds generally in three phases:

1. The golf course is graphically represented in one or more images that are digitized and stored on a computer.

2. The images and the location on the images of the several key features of the golf course, including tee, fairway, rough, garden spot, sand trap and other hazards, and the green are mapped to a database array where every point on the image is mapped to an array element which contains information about those geographic coordinates on the golf course. For example, the shot performance overlay would contain preformatted position information for the several shots (first shot, second shot).

3. A golfer marks the position of each shot on a scoring booklet which includes the graphical counterpart of the image stored in the computer. The accuracy of the entry on the scoring booklet is enhanced by the ability to reference the shot position to geographic landmarks on the golf course. The graphical image may include representations of various geographic landmarks of each hole, such as water hydrants, sprinkler heads, drain structures, prominent trees, hills and hazards. By lining up the position of the ball against these landmarks, the position on the image which corresponds to the actual position on the golf course can be accurately replicated. It has been found that it is possible to locate a ball on the scoring booklet to an accuracy that approximates one yard. An enlarged image of the green is provided to more accurately locate the ball position on this critical area.

After the round, the golfer transfers each shot to the database (normally utilizing a web site and a point and click interface) and enters the information about the shot, including at least the golf club utilized and preferably swing information.

4. The information about each golfer's game is statistically analyzed, including the distance obtained with each club, the percentages associated with obtaining a favorable lie (fairway, garden spot or hazard) on each shot and the position of the final shot on the green (cup or pin position). The information is compared to previous rounds by that golfer on that course and to other golfers as desired.

The detailed process of graphical representation of a golf course proceeds on a hole-by-hole basis. After a golf course signs up as an affiliate course, aerial photographs are taken of each hole. These photographs are taken from a sufficient altitude so as to minimize the perspective distortion with distance. It has been found that an altitude of 1500 feet for up to 400 yards (1200 feet) is adequate to avoid excessive visual distortions and avoids the need for an algorithm to interpolate between the marked position and the true geographic coordinates of the spot. This results in a ratio of 1500/1200 or 1.25 feet of altitude for each foot of the length of the hole. If greater detail is desired, multiple lower altitude photos can be taken. The scale of each image is equalized and then the images "stitched" together to make the final image. For example, from 500 feet, a picture could be stitched together from three images and would have greater detail and the same freedom from perspective distortion as a single image from 1500 feet. An altitude of 500 feet has been found to be adequately low for the higher resolution required for enlarged images of greens.

Figure 4:
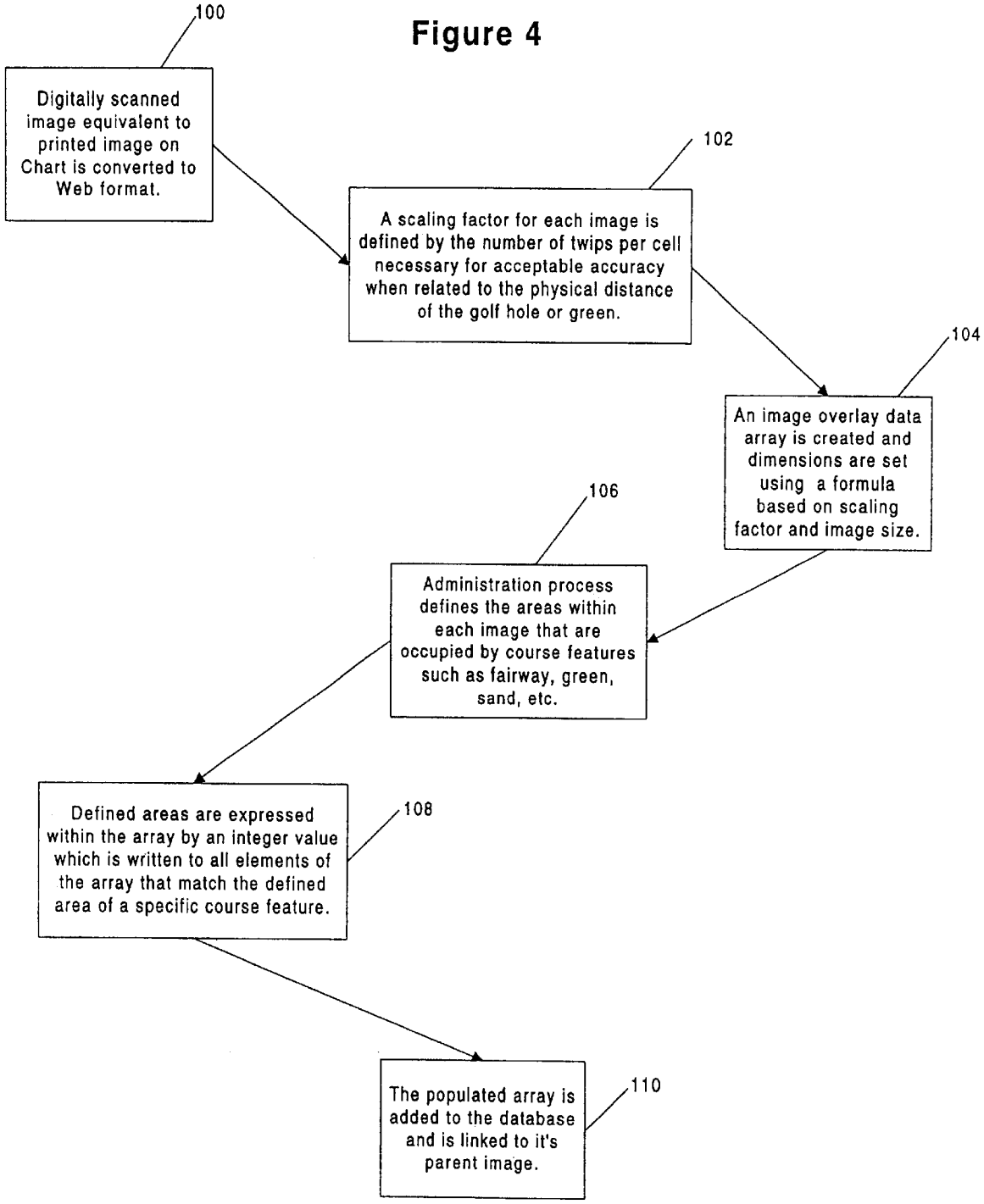
FIG. 4 illustrates the process by which the various features on the course are converted into values on an image array.

FIG. 4 illustrates the process for displaying an active course map via the Web. A digital image of the photograph is scanned at process 100 so that each twip of the image is about two feet on a side. (A twip is a unit of screen measurement equal to 1/20 of a printer's point). Thus a square with 10-foot sides would be five twips by five twips. A square of this size is a suitable size for a cell in a data array. Each cell is associated with specific x,y value that can be used to determine the distance and direction between any two points on the hole.

Each image carries a resolution factor (scaling factor) which defines the physical dimension of a twip within the context of that image (process 102). For example, on a 300 yard hole, where the screen image which is seven inches in length, when printed, will have a twip resolution of (300×3)/7=(128.47 feet/inch)/1440=0.09 feet/twip but a 500 yard hole (all other factors being equal) would calculate to 0.16 feet/twip. It is obvious then greater accuracy will be achieved on those holes which are shorter in length physically but yet which are displayed graphically in a size equal to the longer holes.

Because the resolution varies depending on the length of the hole, the minimum resolution is set to produce acceptable results from the longest holes. In the present embodiment the resolution equals to a precision of no less than 6 feet on the longest fairways and no less than one foot on the largest greens.

The use of twips produces a direct spacial relationship between mouse position and the corresponding position on the golf course. The distance between two sequential ball positions is determined by a simple geometric algorithm using the x,y coordinate pairs against an array of twip values vs. geometric position. An example of this would be two shots on a hole with a scaling factor of 20. If the first shot is located at x=4,200 and y=1,800 and the second shot is located at x=7,400 and y=400. The forward distance of the second shot is 7,400−4,200=3200/20=160 yards. The drift on the second shot is 1,800−400=1,400/20=70 yards to the left.

Each cell in the data array has a twip-determined x, y value. Each cell also has an associated value from one to nine which may be denominated as follows:

1=Tee
2=Fairway
3=Green
4=Center of Fairway
5=Rough
6=Sand
7=Water
8=Hazard
9=Out of bounds When the proper database array element (cell) is accessed via x,y coordinates, the system instantly knows in what type of area the ball was located. Because each image array has a unique feet/twip value the distance between any two points in the grid may also be instantly calculated.

When the user indicates a shot position by clicking on the photographic image on the website, an underlying image map translates this location into an x, y coordinate pair. Once the coordinate location for the shot is known the system can begin analysis on that shot. Analysis is based around the concept of image overlays 104. The current best mode of operation uses two image overlays, however additional overlays can be created and easily added to the system to analyze additional course attributes. These image overlays relate logical features of a course to the true physical features of the golf course. Image overlays are data arrays in which each element of the array corresponds to a cell (a block of twips as defined previously). The first overlay is responsible for defining the type of physical feature (fairway, sand trap, etc.) of the ball position. In this overlay, each element of the array holds only one integer which maps to a specific type feature. In this case 1=Tee, 2=Fairway, 3=Green, etc. In this way, any type of physical feature can be defined and recorded very efficiently. The second overlay defines areas of the course which are preferable positions for each shot. Every hole on a golf course has locations that are better than others in relation to ease of play. Ideally a golfer wants to be in a location on his approach to the green where he can make an easy rather than a difficult shot. If a golfer is in this location for his approach it follows that he has just made a good tee shot. Therefore, the second overlay for "shot rating" is simply an array in which each element is a stroke number. Some elements of this overlay will be null because they are not areas on the hole that correspond to a good shot position.

Image overlays are created using an administration process 106. An operator clicks on as many points as necessary to describe a complex polygon which in turn describes an area on the image. Having described the area the operator then defines an area descriptor at process 108. The descriptor is related to the condition of the area (the physical feature of the golf course for a shot in that area) such as green, fairway, or rough. When an area is defined and a descriptor is applied the administration function writes the correct descriptor value to all array elements which exist in this area. The populated data array is added to the database and linked to the original image at process 110. Additional overlays can be easily added as they are logical mappings to physical spaces.

If the stroke value of the golfer's current shot matches the value in the array corresponding to the ball position, the golfer has made a good shot. An additional overlay can be added to describe additional shot ratings such as "better" or "best" shot locations etc. Distance need not be defined by an overlay but may be calculated on the fly for each shot. The HTML markup language is able to use a feature called an image map in order to define attributes about an image based on the position or location of twips within the image.

The distance of any golf shot has two components which are forward distance or distance along the center line of the hole/fairway towards the pin and "drift" or movement of the ball away from the center line of the hole/fairway. True distance for each shot is the length of the hypotenuse of the right triangle, created by forward distance and drift. True distance can be calculated as needed; however, most important to the golfer is forward distance and the amount of drift on any shot. Therefore these are the two distances most commonly used for statistical analysis.

Standard CERN-type image maps are created using an image and embedded HTML tags within the document body. These are loaded on the golfer's computer by a Java applet and browser. These HTML tags however, can only redirect the call of a function. When other functions such as database access are required, the server must be involved. The present invention uses a tool which is referred to as Extreme High Quality Imaging or "EHQI". This tool is used in preference to conventional image mapping. After a client side map is created with a Java applet; the applet handles all the events within the browser. This makes the process platform independent and cross-browser compatible. The applet displays a user interface within the browser window and interacts with the user for any calculation functions or manipulation of the image. This eliminates the need for round trips to a server in order to service the client side process. The applet uses server access, via dynamically created SQL queries, only for data that is stored on the server, and not data that can be calculated locally such as shot distance, type of lie, etc.

The applet tracks mouse moves over any activated area and does not need the server except for historical data. The images are only accessible to un-trusted applets if they exist in the "classpath". In the exemplary implementation this data area is the "sandbox" or "jar" which is downloaded during the browser session but is not available to the client machine OS and file system. In order to implement EHQI on a slow connection (such as a 56K modem or less) the jar would exist on the local machine by either being downloaded earlier or loaded on a local device such as CD.

Figure 5:
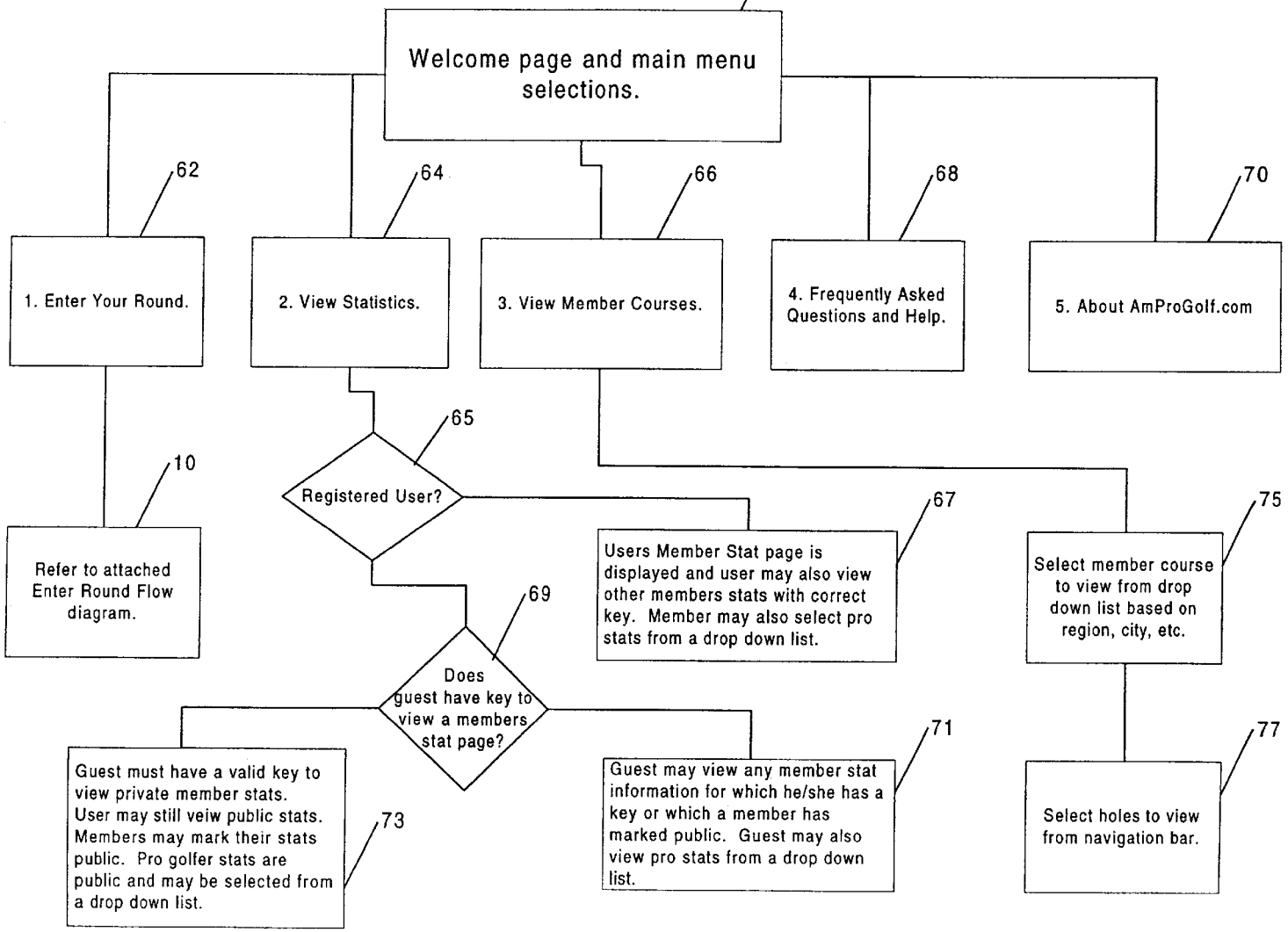
FIG. 5 represents the initial selections available to the new and registered users on the Web page.

Referring to FIG. 5, the web site 60 has a link to the "enter-yourround" function 62, View Statistics 64; View Member Courses 66; Frequently Asked Questions 68 an information about the provider 70.

The View Statistics function allows a user to directly access all statistics for which the user (member or guest) is authorized. It is first determined at 65 whether the user is registered. Registered users gain immediate access to the Member Stat page at 67. Guests are classified at 69 by whether they have been given a key to view a member's stats page at 71. A guest with a key has access to otherwise private member statistics. Unauthorized guests are limited to public and pro statistics 73.

The View Statistics function allows a user to directly access all statistics for which the user (member or guest) is authorized. It is first determined at 65 whether the user is registered. Registered users gain immediate access to the Member Stat page at 67. Guests are classified at 69 by whether they have been given a key to view a member's stats page at 71. A guest with a key has access to otherwise private member statistics. Unauthorized guests are limited to public and pro statistics 73.

Figure 2:
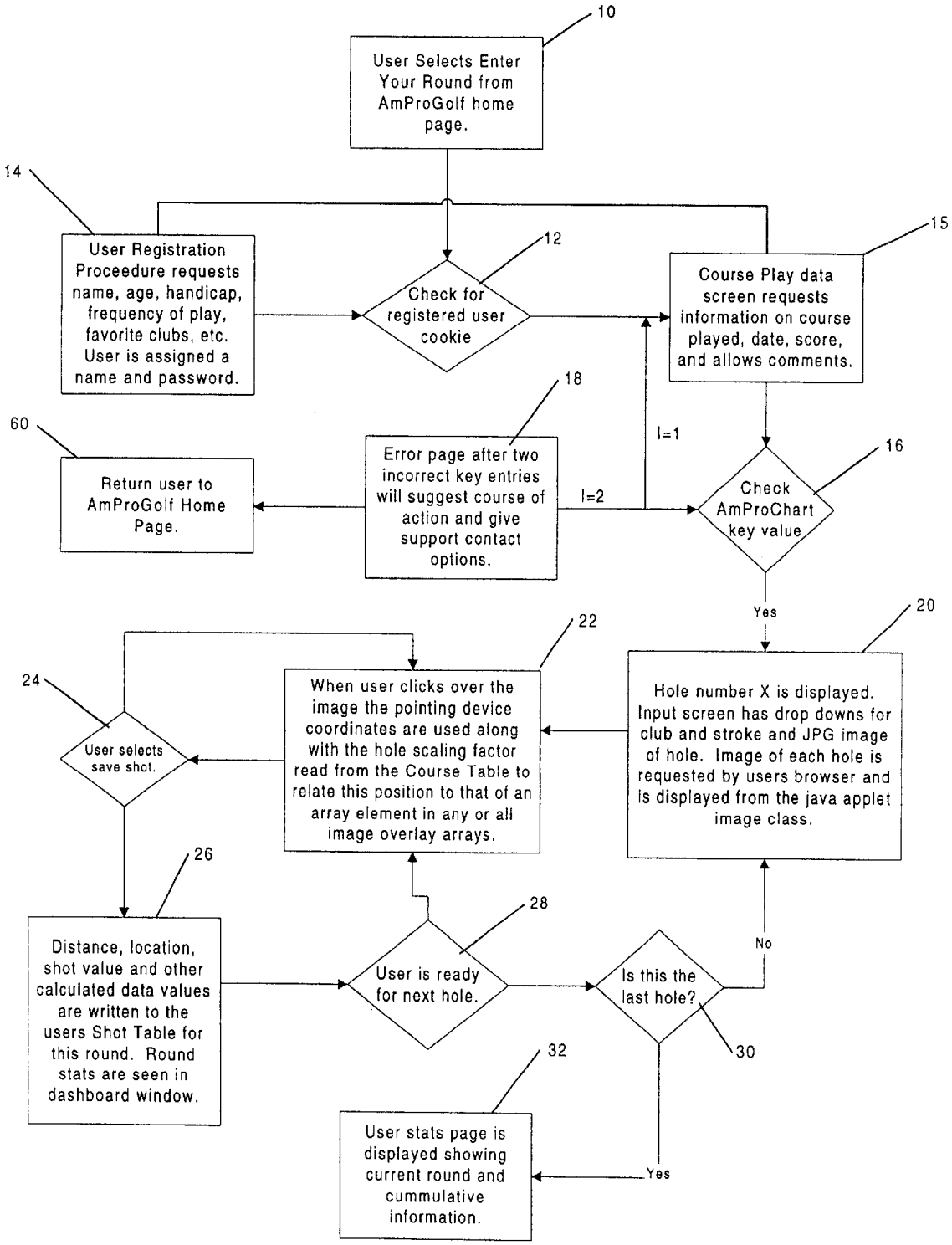
FIG. 2 Illustrates the process by which a player enters information about a round through a Web Site.

The View Members Courses function 66 allows visitors to view the course maps at 75 and specific holes at 77. When the user selects the "enter-your-round" function, the program cheeks for whether or not the golfer is registered by looking for an HTML cookie 12 (see FIG. 2). If not, the registration process 14 proceeds to gather name, age, handicap, frequency of play, favorite clubs and related information about the golfer and assigns a user name and password according to conventional Internet registration practice. The user is then asked to identify the course played, date, score and insert any desired comments at function 15. Process 16 checks for the completion of all necessary fields and traps errors at process 18 by returning to the home page (FIG. 5). Once the complete information is obtained, the user is presented with an image of the first hole at 20. When the user clicks to indicate a shot position, a particular cell x,y value is identified by process 22 and when the shot position is confirmed by process 24, the distance, location, shot value, club and other data for the shot are written to the user's Play Hole Table by process 26 and then the user is moved along by process 28 to the next hole until the data for the entire course is entered as determined by the process 30 which initiates the display of user stats showing the data for the current round and information on previous rounds by process 32. The calculation for shot distance is simply y2−y1 for distance, x2−x1 for drift, (total distance is found by calculating the length of the hypotenuse of this right triangle.)

Figure 3:
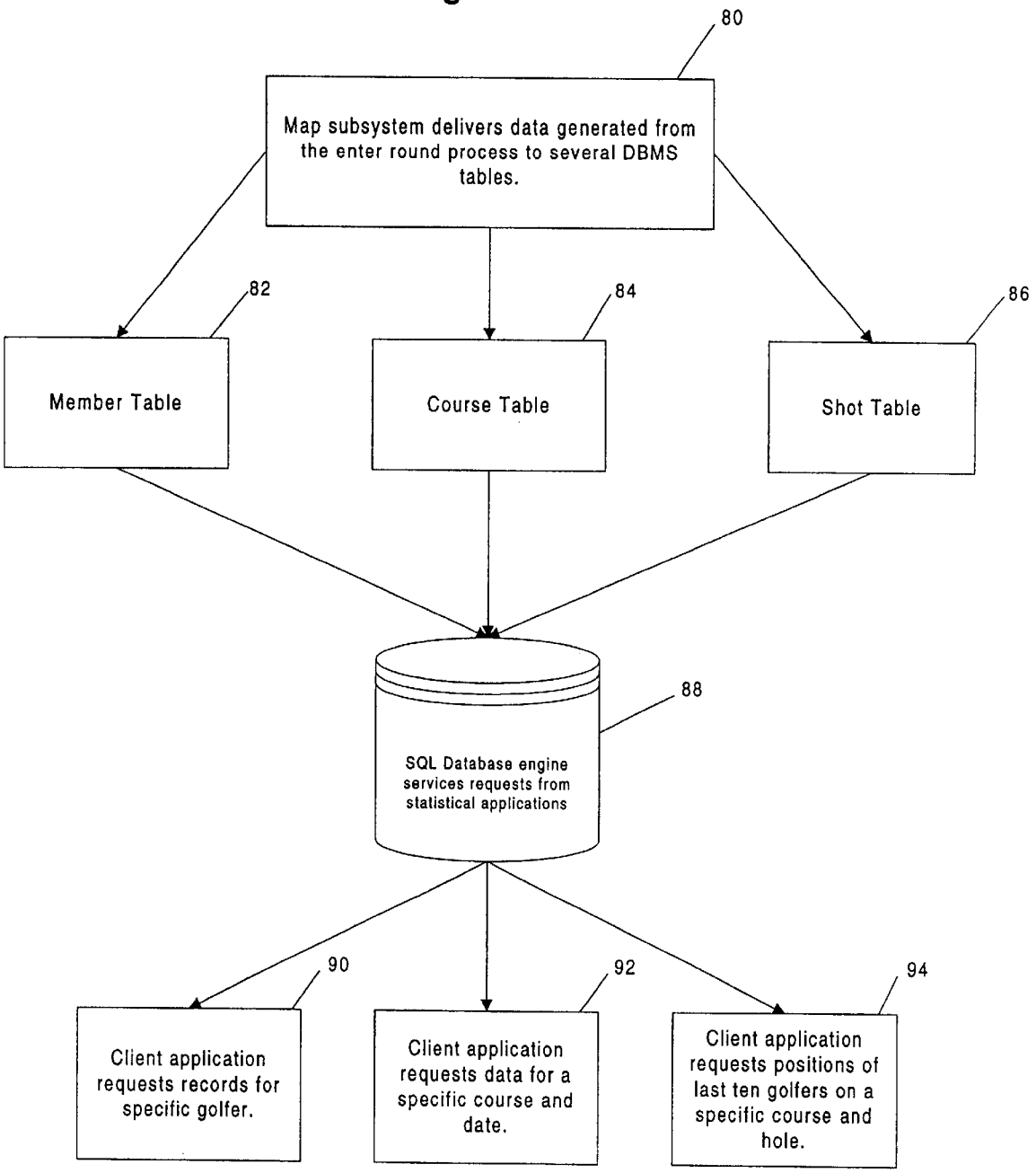
FIG. 3 Illustrates the process by which acquired data is stored and statistically analyzed.

The method for producing statistics for the golfer is illustrated in FIG. 3. The map subsystem at process 80 delivers data to the Member Table 82, the Course Table 84 and Shot Table 86. Once the golfer's shot data has been written to the Shot Table 86, all analysis is done by SQL Queries through the database engine 88.

The client application is enabled to make request from the database engine 88 by process 90 which requests records for a specific golfer, process 92 which requests records for a specific course and date, and process 94 which requests records on relative positions such as the statistical ranking of the positions of the last ten golfers on a specific course and hole. An example query is: "Select all from Shot Table where Member ID=XXX and hole #=5 and Shot number=1"

this would give the golfer all tee shots on hole 5. The distances could then be averaged or locations compared.

The fundamental determination for every cell on the physical feature overlay array is the location type (physical feature type) for the shot. The value assigned describes the conditions at the ball position, such as fairway, rough, sand trap, water hazard, green and other prominent features which affect playability. These features can include the garden spot determined from the course professional as being the area on the fairway as the most desirable spot for placement of the first shot (tee shot).

FIG. 1 is a flow chart showing the process by which the chart booklets are generated. Aerial photos are digitized at process 34. A suitable digitized image can be generated by a Scitex Eversmart Pro scanning a 1.5×2.0 inch negative for target output of 600 DPI printed at 8.5×11.0 inches. The digitized image is transferred to the course booklet as printable images by process 36. Standard desktop publishing applications such as Adobe Photoshop can be utilized for image cropping, sizing, color adjustment etc. and Adobe Pagemaker to produce the finished booklet. The hole detail is added to the same section of the course booklet to include provision for marking the clubs utilized, overall yardage and other description by process 38. Course professionals play the course utilizing the booklet to confirm the accuracy of the information and the perceptions of the graphical displays at process 40 and any necessary corrections made at process 42. After the final test in process 44, the production booklet is produced at process 46. The booklet use may be restricted by codes which are printed on the booklet by process 50 and entered into the website so that a particular course booklet number can only be used a single time by a registered user. These booklets may be displayed at point of sale locations at the golf course itself and for affiliated golf courses by process 52.

The Chart Sub-System refers to all activities which map and record a golfer's previous play information previous to and after the current golf round. This sub-system is based on the creation, distribution (in the form of the chart booklet) and use by the golfer on the course of an accurate aerial image of each tee, fairway, green and course feature, from which the golfer may accurately estimate and record the position where each shot comes to rest. Information on the club used and swing (e.g. full or ½ swing).

The Map subsystem describes all activities which acquire and display data via an HTML and Java client-server session. The subsystem provides the means for a golfer to transfer data collected in the Chart booklet into a reliable and available statistical analysis engine. Once the table information is collected any suitable database engine can perform the queries. Both Microsoft Access as well as MySQL database servers have been used successfully with the system. These programs also provide the user with the capability for displaying statistics as well as charting of scenarios and trends. The system uses its overlays to describe very concise properties of specific areas, which are then used to compile statistics about shots, or groups of shots, falling within these areas. The Map subsystem allows all charted data to be represented to the user through a logical view, which is then correlated to a physical position on the golf course. This data is then passed to the Statistical sub-system. The overlay process greatly enhances the accuracy and performance of the data transformation process as well as subsequent data analysis.

When the user logs onto a particular course the twip arrays (image overlays), course images and Java client procedures are the only data that must be transferred to the client machine. This greatly reduces the resources required of the client to run the Map sub-system. This also reduces the network resources that must be devoted to each user.

The Statistical sub-system is partially distributed in tables to the client machine. This distribution can be accomplished at the first visit to the web site. These tables hold information such as the shot location for all holes which were birdied, pared, bogied etc. They recall and display. All data is also posted to the central statistical database in the form of golfer ID, date, Course ID, Hole ID, stroke number, club, swing value, x,y coordinate pairs, and location type flag. Exemplary Table, Shot Table and Course Tables are shown in FIG. 7. Statistics about the particular member, such as longest drive and average putts per hole, are stored in a Member Table such as the Exemplary Table in FIG. 6.

The Statistical sub-system controls the activities which correlate and analyze data captured by the Chart sub-system and delivered via the Web sub-system. An example of how this is accomplished using an SQL query example is shown by the process for determining the "Most Improved Club" for the golfer:

Select all from Shot Table where Member ID=XX, and Play date>x/x/x, and club=X" repeat all clubs used by a particular golfer after a certain date then again previous to that date, then average the clubs in both ranges for forward distance and drift. Now subtract all distances of set two from set one. The highest number is the most improved club in distance. Subtracting all drift values of set two from set one and selecting the lowest value will produce the club with most improved accuracy.

Although an exemplary embodiment of the invention has been described above by way of example only, it will be understood by those skilled in the field that modifications may be made to the disclosed embodiment without departing from the scope of the invention, which is defined by the appended claims.

We claim:

1. A golf game analysis system comprising:

a scoring booklet for a golf course with at least a two dimensional image of each hole which accurately displays, without significant perspective distortion, sufficient landmarks visible to a golfer on the golf course so that the resting position of golf shot on the course can be accurately marked on the image;

a computer interface capable of displaying a computer image which corresponds visually with the image on said scoring booklet;

an underlying x, y grid system related to said computer image so that every position on the computer image has a corresponding and unique coordinate value;

at least one image overlay which relates logical features of a golf course as displayed on the computer image to the true physical feature of the golf course, including an overlay that determines whether or not the logical position of the golf shot is physically on the fairway;

a pointing device for selecting a location on said computer image on said computer interface;

pointing event translation means for translating a selected location into a corresponding x, y value and storing the corresponding values in a database; and said database storing information for points on said computer image, about the corresponding position of the golf shot on said golf course, and storing said information keyed to a unique identifier to relate said information so stored to an individual golfer.

2. The golf game analysis system as claimed in claim 1, wherein the position on a golf course includes information on whether that position represents a lie that is fairway, rough, sand trap or green.

3. The golf game analysis system as claimed in claim 2, further comprising a statistical analysis engine for comparing a golfer's performance for particular golf clubs and the information on the lies that resulted from the use of that golf club during at least one round of golf.

4. The golf game analysis system as claimed in claim 1, said database storing information on the club employed.

5. The golf game analysis system of claim 1 wherein the two dimensional image of each hole in the scoring booklet has no more perspective distortion than aerial photographs that are taken from an altitude of at least 1.25 feet for each foot of length along the hole.

* * * * *